US006328189B1

(12) United States Patent
Norden

(10) Patent No.: US 6,328,189 B1
(45) Date of Patent: Dec. 11, 2001

(54) BACK QUIVER SUPPORT SYSTEM

(76) Inventor: Michael J. Norden, 22 - 290 Road S, Defiance, OH (US) 43512

( * ) Notice: Subject to any disclaimer, the term of this patent is extended or adjusted under 35 U.S.C. 154(b) by 0 days.

(21) Appl. No.: 09/715,287

(22) Filed: Nov. 17, 2000

Related U.S. Application Data

(63) Continuation-in-part of application No. 09/253,878, filed on Feb. 22, 1999, now abandoned.

(51) Int. Cl.[7] ..... A45F 5/00

(52) U.S. Cl. ..... 224/197; 224/604; 224/678; 224/916

(58) Field of Search ..... 224/916, 603, 224/604, 605, 197, 678

(56) References Cited

U.S. PATENT DOCUMENTS

D. 331,319 * 12/1992 Stinson ..... D3/100
2,908,432 * 10/1959 Kent ..... 224/916
2,987,230 * 6/1961 Taylor ..... 224/916
3,465,928 * 9/1969 Osterholm ..... 224/916
4,156,496 * 5/1979 Stinson ..... 224/916
5,193,725 * 3/1993 Radocy ..... 224/197
5,803,069 * 9/1998 Schreiber ..... 224/916
5,934,531 * 8/1999 Jablonic et al. ..... 224/222
6,006,734 * 12/1999 Sodaro ..... 224/916

* cited by examiner

*Primary Examiner*—Stephen P. Garbe

(57) ABSTRACT

A system for supporting a quiver comprising a belt positioned over a wearer's shoulder, the belt having two couplable free ends and a central aperture there through and with a swivel pin extending through the aperture radially outwardly from a central extent of the belt adjacent to the back of a wearer; a support post having an aperture at its upper extent receiving the swivel pin and with a plurality of supplemental apertures along the length thereof; and coupling means on the support post for removably supporting a quiver.

2 Claims, 3 Drawing Sheets

FIG 3
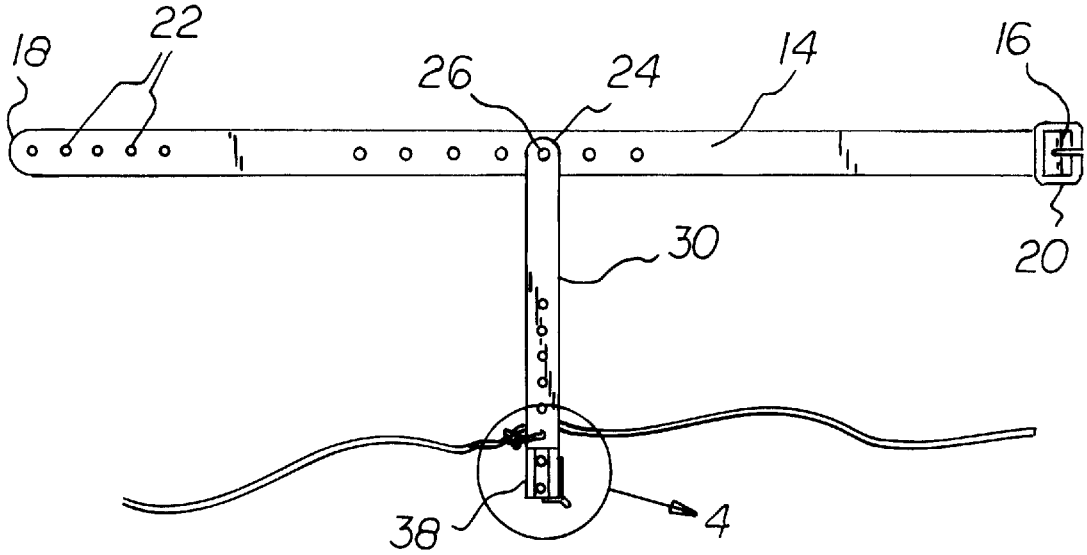
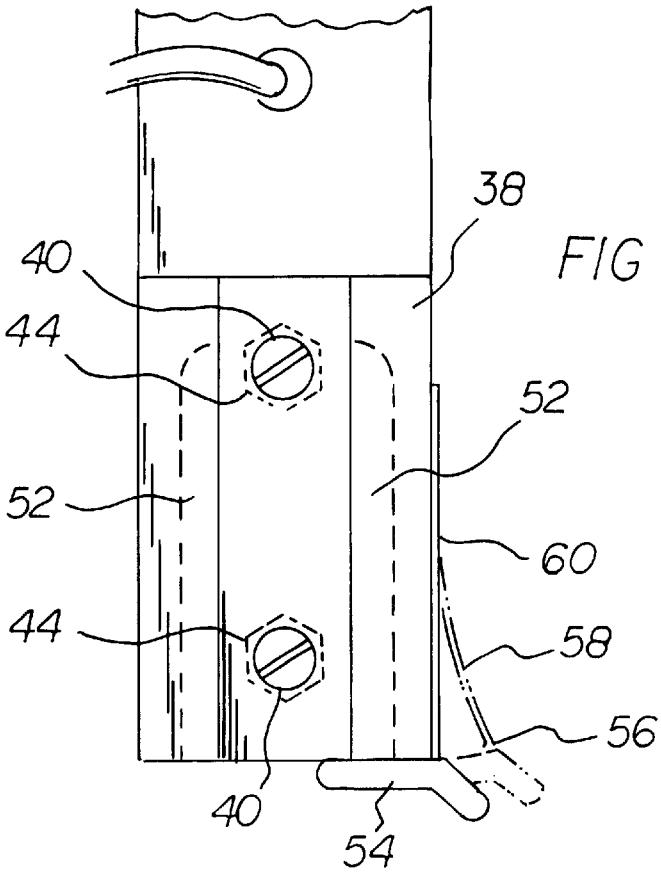
FIG 4

BACK QUIVER SUPPORT SYSTEM

RELATED APPLICATION

The present invention is a continuation in part of application Ser. No. 09/253,878 filed on Feb. 22, 1999 now abandoned.

BACKGROUND OF THE INVENTION

1. Field of the Invention

The present invention relates to a back quiver support system and more particularly pertains to allowing any bow quiver to be worn as a support for arrows.

2. Description of the Prior Art

The use of quivers of known designs and configurations is known in the prior art. More specifically, quiver supports of known designs and configurations heretofore devised and utilized for the purpose of supporting arrows through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 3,973,776 to Ole discloses an arrow quiver and pack frame. U.S. Pat. No. 4,073,328 to Franklin discloses an arrow quiver. U.S. Design Pat. No. Des. 331,319 to Stinson discloses an arrow quiver. European Application Number 342 109 to Morel discloses a retractable arrow support device. U.S. Pat. No. 5,452,703 to Bateman, III discloses an arrow holder for different sized arrows. Lastly, U.S. Pat. No. 3,366,232 to Elfstrom et al. discloses an arrow holder and spacer pad.

While these devices fulfill their respective, particular objectives and requirements, the aforementioned patents do not describe a quiver for arrow support as disclosed herein. In this respect, the back quiver support according to the present invention substantially departs from the conventional concepts and designs of the prior art, and in doing so provides an apparatus primarily developed for the purpose of allowing any quiver to be supported for suer safety and convenience.

Therefore, it can be appreciated that there exists a continuing need for a new and improved back quiver support which can be used for allowing any bow quiver to be worn for improved wearer safety and convenience. In this regard, the present invention substantially fulfills this need.

SUMMARY OF THE INVENTION

In view of the foregoing disadvantages inherent in the known types of quiver supports of known designs and configurations now present in the prior art, the present invention provides an improved back quiver support. As such, the general purpose of the present invention, which will be described subsequently in greater detail, is to provide a new and improved back quiver support which has all the advantages of the prior art and none of the disadvantages.

To attain this, the present invention essentially comprises a new and improved back quiver support system which allows any bow quiver to be worn as a back quiver comprising, in combination a belt positioned over the shoulder of a wearer, the belt having two couplable free ends with a buckle at one end and holes at the other end and with a central aperture there through and with a swivel pin extending through the aperture outwardly from a central extent of the belt adjacent to the back of a wearer. Next provided is a support post having an aperture at its upper extent receiving the swivel pin and with a plurality of equally spaced supplemental apertures along the length thereof. Next provided is an interior first connector member having two vertically spaced apertures with nuts and bolts coupling the first connector member to the support post at a predetermined height. Next provided is an exterior second connector member having enlarged lateral projections for removable coupling to the second connector to the first connector, the first and second connectors being removably coupled with respect to each other from the bottom of the first connector for the ready removal of a quiver from the belt. Next provided is a cord extending through one of the apertures of the post for tying over the shoulder of the hunter. Next provided is a locking finger positionable beneath the first connector to hold the second connector within the first connector and with a leaf spring attached to the first connector to hold the second connector beneath the first connector and adapted to allow the movement of the locking finger away from the lower end of the first connector for thereby permitting the movement of the second connector with respect to the first connector. Lastly provided is a quiver having a rectilinear lower extent with an open top for receipt of heads of arrows, an upper horizontal extent with a plurality of keyhole-shaped recesses extending inwardly from the periphery for the receipt of the upper extents of arrows and with an intermediate extent coupled to the second connector.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved back quiver support which has all of the advantages of the prior art quiver supports of known designs and configurations and none of the disadvantages.

It is another object of the present invention to provide a new and improved back quiver support which may be easily and efficiently manufactured and marketed.

It is further object of the present invention to provide a new and improved back quiver support which is of durable and reliable constructions.

An even further object of the present invention is to provide a new and improved back quiver support which is susceptible of a low cost of manufacture with regard to both materials and labor, and which accordingly is then susceptible of low prices of sale to the consuming public, thereby making such back quiver economically available to the buying public.

Even still another object of the present invention is to provide a back quiver support for allowing any bow quiver to be worn as an arrow holder.

Lastly, it is an object of the present invention to provide a system for supporting a quiver comprising a belt positioned over a wearer's shoulder, the belt having two couplable free ends and a central aperture there through and with a swivel pin extending through the aperture radially outwardly from a central extent of the belt adjacent to the back of a wearer; a support post having an aperture at its upper extent receiving the swivel pin and with a plurality of supplemental apertures along the length thereof; and coupling means on the support post for removably supporting a quiver.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a plan view of the support but shown independent of the quiver.

FIG. 4 is an enlarged view of the lower extent of the support taken at circle 4 of FIG. 3.

The same reference numerals refer to the same parts through the various Figures.

DESCRIPTION OF THE PREFERRED EMBODIMENT

Figure 1:
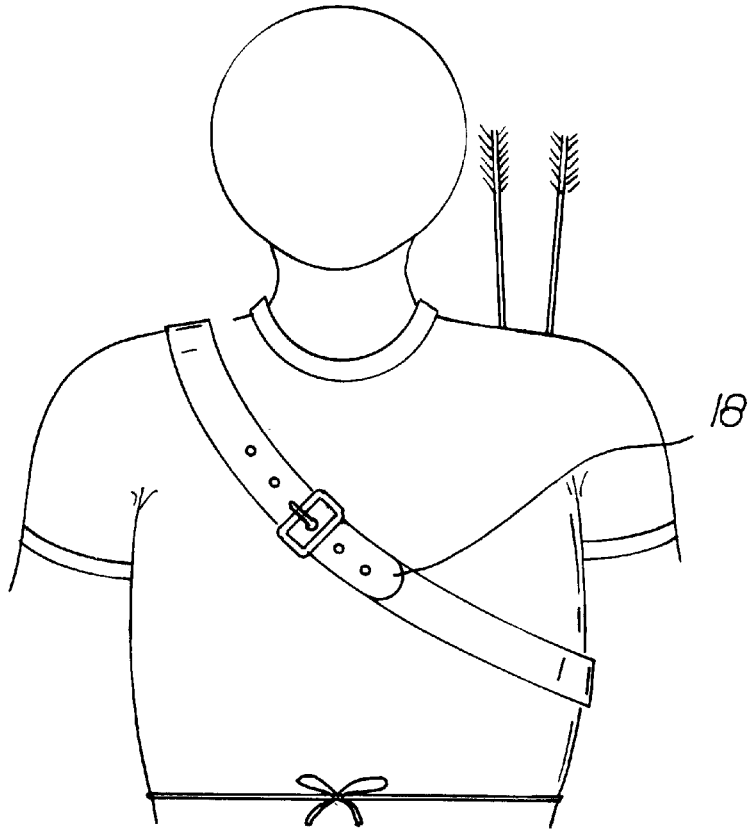
FIG. 1 is a front elevational view of the preferred embodiment of the back quiver support constructed in accordance with the principles of the present invention.
Figure 2:
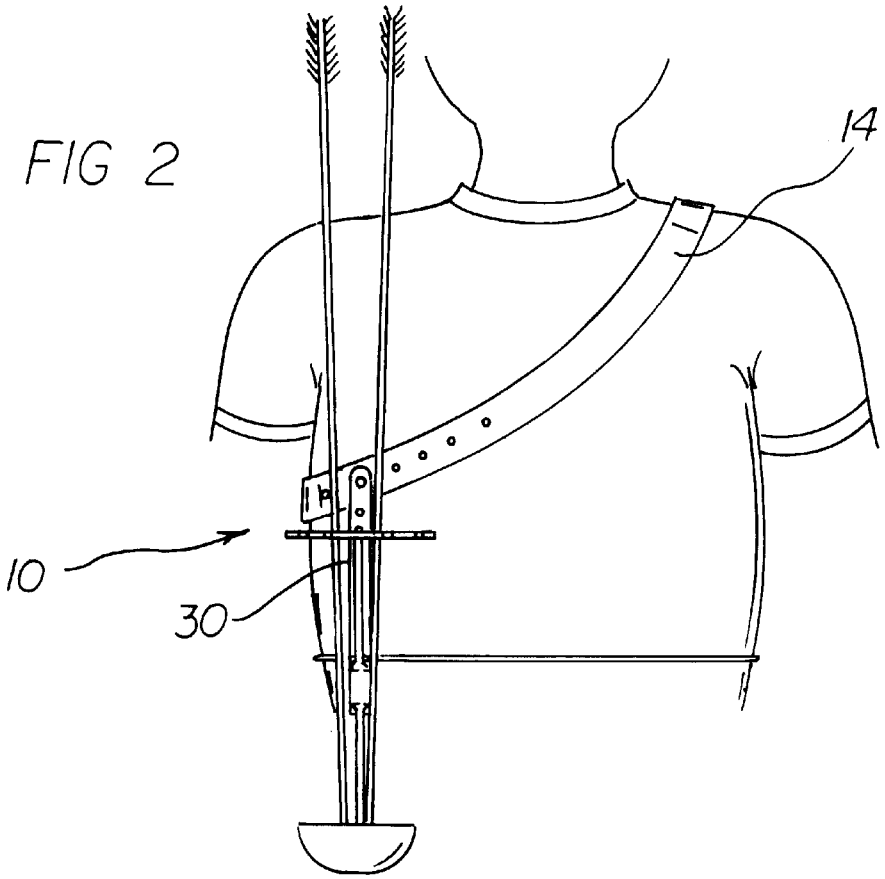
FIG. 2 is a rear elevational view taken through the coupling swivel between the belt and quiver.
Figure 5:
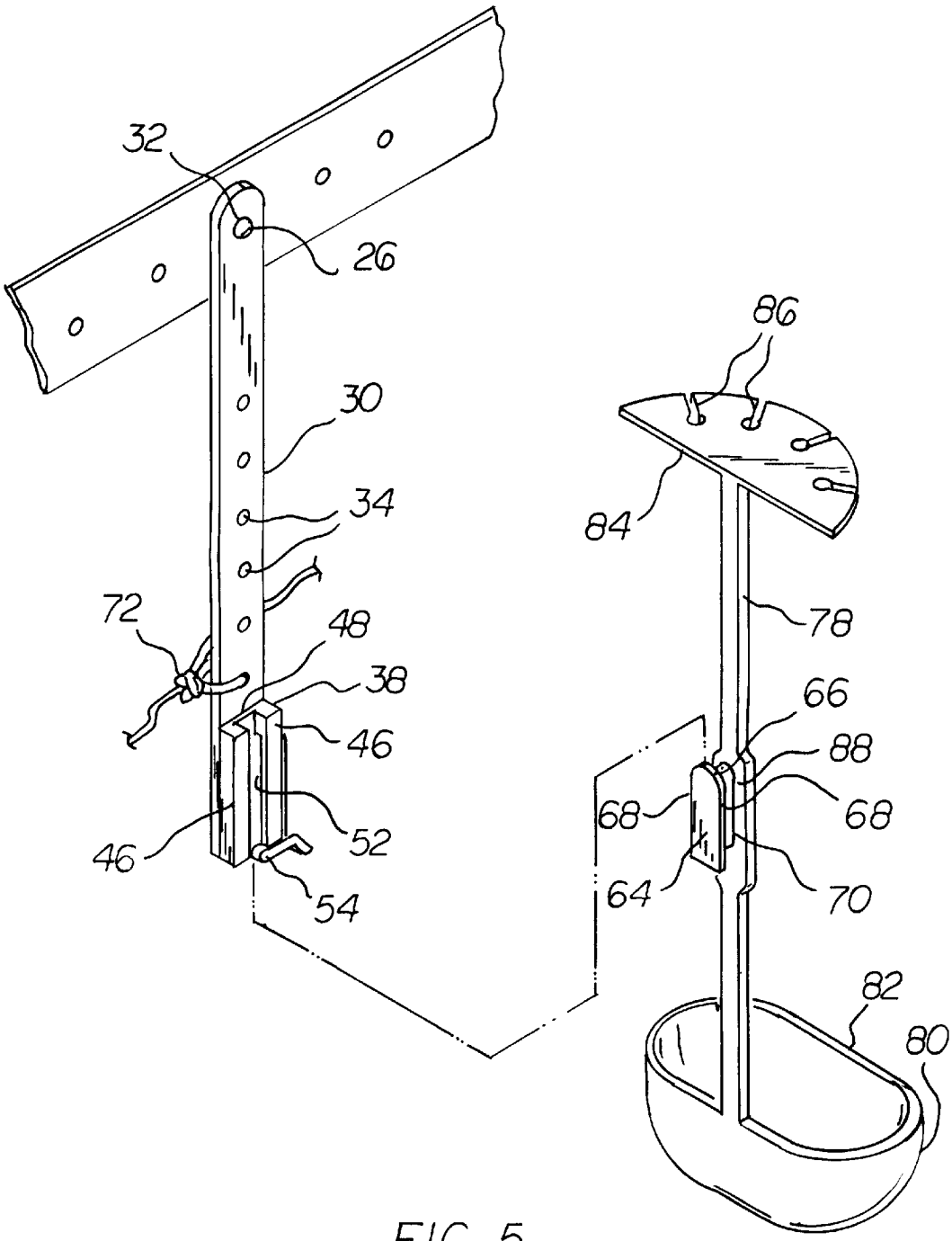
FIG. 5 is an exploded perspective view of the support and the quiver.

With reference now to the drawings, and in particular to FIG. 1 thereof, the preferred embodiment of the new and improved, system for supporting a quiver embodying the principles and concepts of the present invention and generally designated by the reference numeral 10 will be described.

The system of the present invention, is adapted to support a back quiver 10, is comprised of a plurality of components. Such components in their broadest context include a belt, a quiver support post, a strap, a first connector and a second connector. Such components are individually configured and correlated with respect to each other so as to attain the desired objective.

The present invention as described herein is a new and improved support system 10 which allows any bow quiver to be worn as a back quiver.

The system includes a belt 14. Such belt is positioned over the shoulder of a wearer. The belt has two couplable free ends 16, 18 with a buckle 20 at one end and holes 22 at the other end. A central aperture 24 extends through a central extent of the belt. In addition, a swivel pin 26 is located through the aperture and extends outwardly from a central extent of the belt.

It is positioned, preferably, adjacent to the back of a wearer during operation and use.

The system further comprises a support post 30. The support post has an aperture 32 at its upper extent. Such aperture is for receiving the swivel pin. There are also provided a plurality of supplemental apertures 34 along the length thereof for allowing the selective positioning of a first connector and a quiver.

Additionally provided is an interior first connector 38. The first connector has a plurality of vertically spaced apertures 40, preferably two. Two nuts 42 and bolts 44 couple the first connector to the support post at a preselected height by removable coupling with respect to any adjacent two of the spaced apertures. Each bolt has a head on the exterior face of the first connector with associated nuts in the interior face of the vertical post.

The first connector has enlarged vertical sides 46 with a thin central extent 48 there between in which the spaced apertures 40 are located. Undercut regions 52 extend from the bottom to a location adjacent to the top.

A locking finger 54 is coupled to the lower end 56 of the leaf spring 58. The upper end 60 of the leaf spring is attached to a central extent of one side of the first connector. As such, the leaf spring normally positions the locking finger beneath the lower end of the first connector in a lock orientation. The wearer may use a finger to move the locking finger to the dotted line position in FIG. 4, an unlocked orientation, for removably coupling a second connector to the first connector.

Further included in the system is an exterior second connector 64 having a plate 66 with enlarged lateral projections 68 removably received in the undercut regions 52. A coupler 70 joins the plate 66 to a quiver of any desired type. The coupler is sized to fit between the enlarged sides 46 of the first connector. The first and second connectors are removably coupled with respect to each other for the ready removal of the quiver from the belt. The locking finger 54 on the bottom of the first connector member limits the downward movement of the second connector with respect thereto unless a wearer deflects the locking finger.

Additionally provided in the system is a cord 72 which extends through one apertures 34 in the support post, secured thereto by a knot. This functions for tying around the waist of the hunter for securement purposes.

The system also included a quiver 78. The preferred quiver has a rectilinear lower extent 80 with an open top 82. Such top is for receipt of heads of arrows. The quiver also includes an upper horizontal extent 84. A plurality of keyhole-shaped recesses 86 extend inwardly from the periphery. Such recesses are for the receipt of the upper extents of arrows. An intermediate vertically extending extent 88 is also provided for attachment to the second connector. Other types of quivers may be utilized with the system of the present invention.

The back quiver support system as disclosed herein is a quiver holder which allows any bow quiver to be worn as a back quiver. The invention consists of a large belt, a plastic holder and a cord. The belt is buckled around the wearer's shoulder. The holder, preferably plastic, has a bracket which attaches to the bow hunter's arrow quiver and the cord ties around the wearer's waist keeping the quiver secured close to the wearer's body.

The back quiver support system allows the wearer to wear a back quiver without the noise and arrow damage which can be caused by the quiver holders currently on the market.

The back quiver support system is lightweight, quiet and easy to use.

The back quiver support system can be used with any quiver. This enables the hunter to keep the quiver that he feels most comfortable using. This device can be used by both right and left handed wearers. The simple and very adjustable design can be worn over either shoulder which allows the wearer to experiment with the holder until he or she finds the most comfortable position.

When the hunter gets to his or her tree stand, the quiver can be attached to the tree stand. This allows the hunter to keep the arrows close at hand for that all important second shot.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the-exact construction and operation shown and described, and accordingly, all suitable modifications and equivalents may be resorted to, falling within the scope of the invention.

What is claimed as being new and desired to be protected by Letters Patent of the United States is as follows:

1. A new and improved back quiver support system which allows any bow quiver to be worn as a back quiver comprising, in combination:

a belt positioned over the shoulder of a wearer, the belt having two couplable free ends with a buckle at one end and holes at the other end and with a central aperture there through and with a swivel pin extending through the aperture outwardly from a central extent of the belt adjacent to the back of a wearer;

a support post having an aperture at its upper extent receiving the swivel pin and with a plurality of equally spaced supplemental apertures along the length thereof;

an interior first connector member having two vertically spaced apertures with nuts and bolts coupling the first connector member to the support post at a predetermined height;

an exterior second connector member having enlarged lateral projections for removable coupling to the second connector to the first connector, the first and second connectors being removably coupled with respect to each other from the bottom of the first connector for the ready removal of a quiver from the belt;

a cord extending through one of the apertures of the post for tying over the shoulder of the hunter;

a locking finger positionable beneath the first connector to hold the second connector within the first connector and with a leaf spring attached to the first connector to hold the second connector beneath the first connector and adapted to allow the movement of the locking finger away from the lower end of the first connector for thereby permitting the movement of the second connector with respect to the first connector; and a quiver having a rectilinear lower extent with an open top for receipt of heads of arrows, an upper horizontal extent with a plurality of keyhole-shaped recesses extending inwardly from the periphery for the receipt of the upper extents of arrows and with an intermediate extent coupled to the second connector.

2. A system for supporting a quiver comprising:

a belt positioned over a wearer's shoulder, the belt having two couplable free ends and a central aperture there through and with a swivel pin extending through the aperture radially outwardly from a central extent of the belt adjacent to the back of a wearer;

a support post having an aperture at its upper extent receiving the swivel pin and with a plurality of supplemental apertures along the length thereof; and coupling means on the support post for removably supporting a quiver.

* * * * *